United States Patent [19]

Yamanaka et al.

[11] Patent Number: 4,836,276

[45] Date of Patent: Jun. 6, 1989

[54] HEAT EXCHANGER FOR ENGINE OIL

[75] Inventors: Yasutoshi Yamanaka; Teruo Izumida, both of Kariya; Kazuya Nomura, Oobu, all of Japan

[73] Assignee: Nippondenso Co., Ltd., Kariya, Japan

[21] Appl. No.: 66,340

[22] Filed: Jun. 23, 1987

[30] Foreign Application Priority Data

Mar. 9, 1987 [JP] Japan ..... 62-53694

[51] Int. Cl.[4] ..... F01P 11/08

[52] U.S. Cl. ..... 165/51; 165/119; 165/160; 165/161; 165/916; 123/41.33

[58] Field of Search ..... 165/38, 51, 119, 165, 165/916, 159, 160, 161; 123/196 AB, 41.33

[56] References Cited

U.S. PATENT DOCUMENTS

| | | | |
|---|---|---|---|
| 721,310 | 2/1903 | Junkers | 165/161 |
| 1,454,053 | 5/1923 | Jones | 165/916 |
| 2,460,754 | 2/1949 | Kidd | 165/38 |
| 2,753,954 | 7/1956 | Tinker | 165/159 |
| 3,584,682 | 6/1971 | Leedham | 165/51 |
| 3,743,011 | 7/1973 | Frost . | |
| 3,754,706 | 8/1973 | Tao . | |
| 4,360,055 | 11/1982 | Frost . | |
| 4,561,494 | 12/1985 | Frost . | |
| 4,638,856 | 1/1987 | Yamanaka et al. | 165/38 |

FOREIGN PATENT DOCUMENTS

| | | | |
|---|---|---|---|
| 59-28219 | 8/1984 | Japan . | |
| 62-59393 | 3/1987 | Japan . | |
| 0708134 | 1/1980 | U.S.S.R. | 165/160 |

*Primary Examiner*—Albert W. Davis, Jr.
*Assistant Examiner*—John K. Ford
*Attorney, Agent, or Firm*—Cushman, Darby & Cushman

[57] ABSTRACT

A heat exchanger transfers the heat from engine oil passing through a plurality of tube members to engine coolant within a housing for cooling the engine oil. The tube members are arranged within the housing in groups with the tube members in each group being aligned radially to form a fan shaped core. The cores are arranged circularly, so that the effective surface of the tube members through which the heat of the engine oil therewithin transfers to the engine coolant outside of the tube members becomes maximized.

10 Claims, 15 Drawing Sheets

HEAT EXCHANGER FOR ENGINE OIL

FIELD OF THE INVENTION

The present invention relates to a heat exchanger exchanging heat between engine oil for an automotive engine and engine coolant for the automotive engine in order to cool the engine oil, for example.

BACK GROUND OF THE INVENTION

Conventionally, a heat exchanger described in Japanese utility model No. 59-28219 has been known as an oil cooler. Such oil cooler is shown in FIG. 25 herein.

The conventional type oil cooler 902 comprises a housing 904 and a plurality of oil cooler units 906. An inlet pipe 908 through which the engine coolant is introduced into the housing 904 and an outlet pipe 910 through which the coolant within the housing 904 flows are provided at the side portion of the housing 904.

Since adjacent pairs of the oil cooler units 906 are separated from each other by a predetermined gap, the coolant introduced through the inlet pipe 908 flows between adjacent pairs of the oil cooler units 906. Each oil cooler unit 906 has an inlet port through which the engine oil is introduced into the oil cooler unit 906 and an outlet port.

The engine oil introduced into the oil cooler unit 906 flows within the oil cooler unit 906 horizontally. The engine oil within the oil cooler unit 906 and the coolant outside of the oil cooler unit 906 exchange their heat with each other through an upper end plate 912 and an lower end plate 914.

The conventonal type oil cooler 902, however, has a disadvantage that the heat of the coolant and that of the engine oil cannot exchange effectively. Since the heat transfers only through the upper and lower end plates 912 and 914, the effective heat transfer area of the heat exchanger must be small.

SUMMARY OF THE INVENTION

An object of the present invention is to provide a heat exchanger having enough effective heat transfer area. Namely, the object of the present invention is to increase heat exchanging effect of the heat exchanger.

In order to attain the above object, a heat exchanger of the present invention employs the features that a first containing space and a second containing space are provided at both ends of a housing, and a plurality of tubes are provided within the housing. One end of each tube is open to the first containing space and the other end of each tube opens to the second containing space. A plurality of tubes are arranged within the housing in groups in such a manner that a each group of tubes makes a fan or sector shaped tube units. The fluid flowing through the tubes is cooled by transferring the heat through the walls of the tubes. Since a number of tubes are provided within the housing, the effective heat transfer area of the tubes become large, so that the fluid flowing through the tubes can be cooled effectively.

DETAIL DESCRIPTION OF THE PREFERRED EMBODIMENTS

Figure 1:
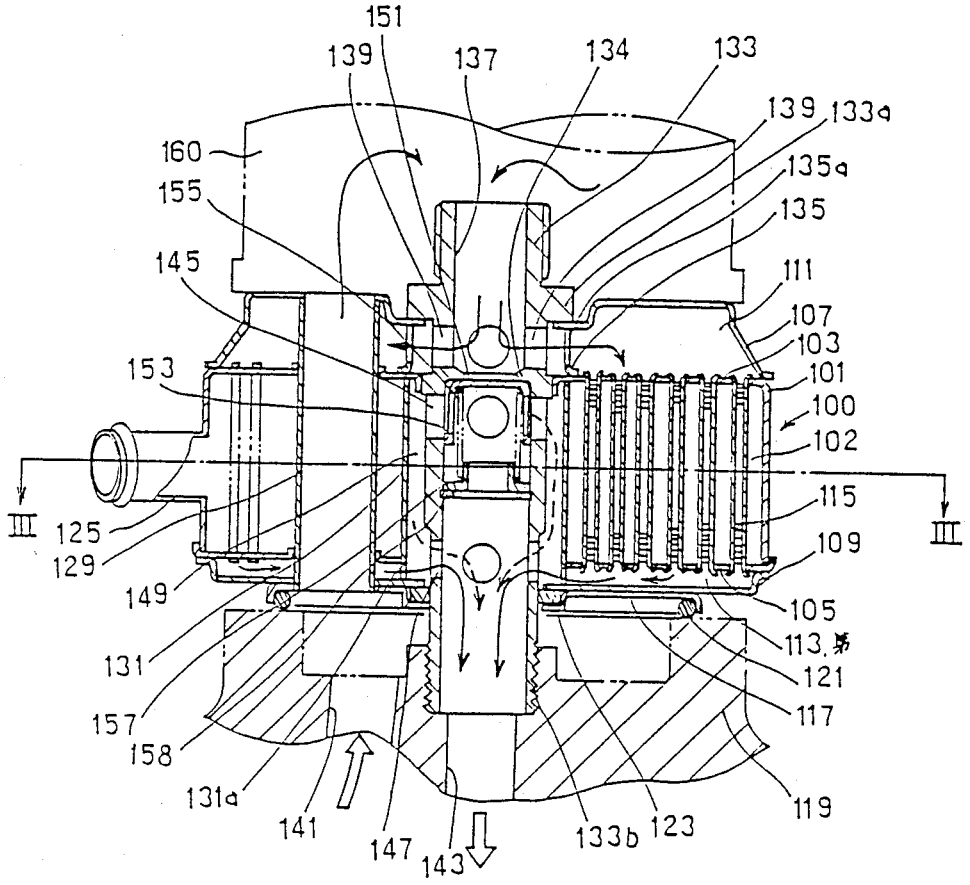
FIG. 1 is a sectional view showing an oil cooler of the first embodiment.
Figure 2:
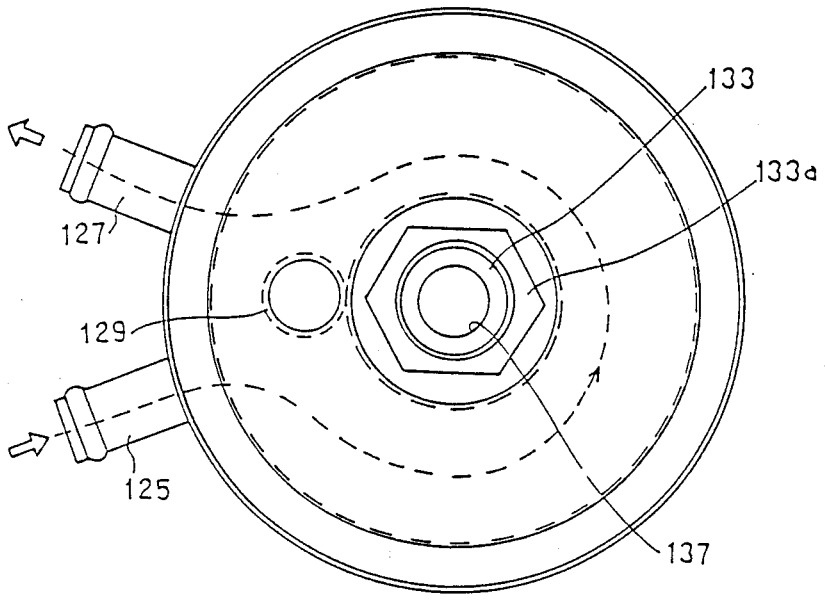
FIG. 2 is a top view of the oil cooler shown in FIG. 1.

A heat exchanger of the present invention used as an oil cooler 100 is explained hereinafter. An inner space 102 is provided within a cylindrical wall 101 having a first end plate 103 and a second end plate 105. The first end plate 103 and the housing 101 are made integrally while the second end plate 105 is fixed to the wall 101 to thus form a housing.

A first containing space 111 is formed between a first plate 107 and the first end plate 103 and a second containing space 113 is formed between a second plate 109 and the second end plate 105.

A plurality of tube members 115 extending vertically and of elliptical or flattened cross-section are provided within the inner space 102 with the short axis of each tube section extending radially of the wall 101. One end of these tubular members 115 is fixed to the first end plate 103 and the other ends of the tubular members 115 are fixed to the second end plate 105 so that one end of the tubular members opens to the first containing space 111 and the other end of those opens to the second containing space 113.

Figure 6:
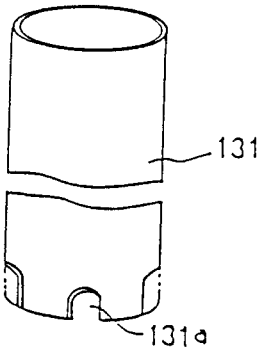
FIG. 6 is a perspective view showing a central pipe used for the oil cooler shown in FIG. 1.

A cylindrical central pipe 131 shown in FIG. 6 is provided at the center portion of the housing. The central pipe 131 has notches 131*a* at a lower portion thereof within the second containing space 113.

A central connecting bolt 133 extends vertically within the central pipe 131. The central connecting bolt 133 has a flange portion 133*a* which abuts the first plate 107 and a threaded portion 133*b* which connects to an engine block 119 to fasten the oil cooler 100 thereto. A base plate 117 is provided between the second plate 109 and the engine block 119 in such a manner that an O-ring 123 is held between the second plate 109 and the base plate 117 and that an O-ring 121 is held between the engine block 119 and the base plate 117.

An oil passing pipe 129 is provided within the oil cooler 100 in such a manner that one end of the passing pipe faces an oil inlet port 141 formed within the engine block 119 and the other end of the passing pipe 129 faces the inlet of an oil filter 160.

Figure 5:
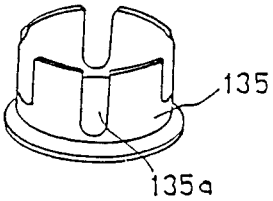
FIG. 5 is a perspective view showing a spacer used for the oil cooler shown in FIG. 1.

The central connecting bolt 133 has a fluid path 137 at the center portion thereof and one end of the bolt 133 faces the outlet of the oil filter 160. The other end of the bolt 133 at which the threaded portion 133*b* is formed faces an oil outlet port 143 formed in the engine block 119. Connecting holes 139 which face the first containing space 111 are formed in the central connecting bolt 133 so that the fluid path 137 is connected with the first containing space 111. A spacer 135 having four notches 135*a* (shown in FIG. 5) is provided within the first containing space 111 in such a manner that the spacer 135 wraps an outer peripheral portion of the central connecting bolt 133. The oil passing through the fluid path 137 and the connecting holes 139 flows toward the first containing space 111 through the notches 135*a*.

An annular flange 134 protruding inwardly is formed in the central connecting bolt 133 and a cup shaped valve body 151 is seatable on the flange 134. The valve 151 is biased toward the flange 134 by a spring 155. One end of the spring 155 is attached to the valve body 151 and the other end of the spring 155 is attached to a holding plate 157. The holding plate 157 is fixed within the fluid path 135 by a circlip 158.

First bypass ports 145 and second bypass ports 147 are formed in the central connecting bolt 133. Connecting ports 153 are formed in the valve body 151 in such a manner that the connecting ports 153 face the first bypass ports 145. Since the pressure of the fluid passing through the fluid path 137 is applied to the valve body 151, the valve body 151 moves downwardly when the pressure of the fluid increases more than the setting force of the spring 155 so that the fluid path 137 is connected to the oil outlet port 143 through the first bypass ports 145, a bypass path 149 and the second bypass ports 147.

Figure 3:
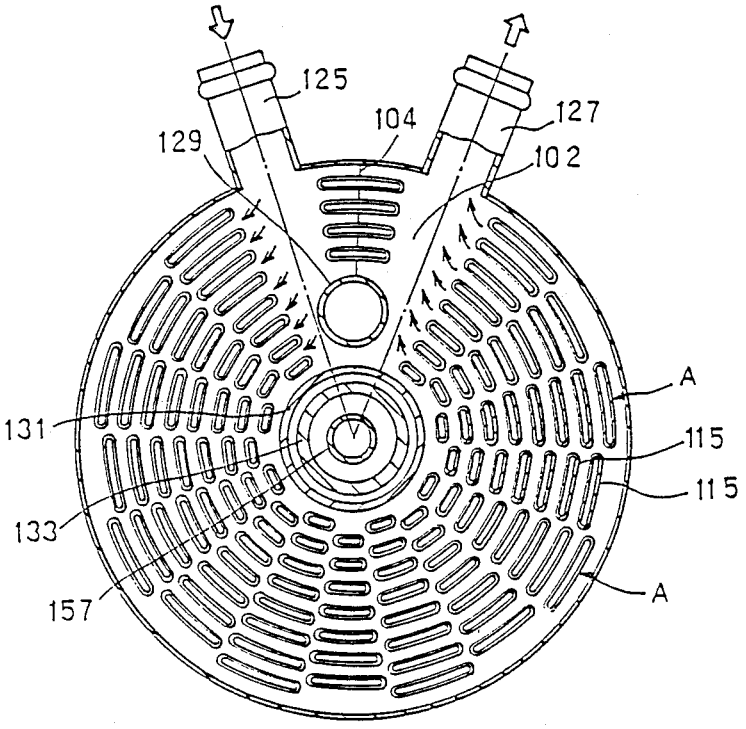
FIG. 3 is a sectional view taken along line III—III line of FIG. 1.

As shown in FIG. 3, a plurality of groups (8) of tube members 115 are arranged in sectors. The sectional area of the tube members 115 increases gradually from the radially innermost tube member 115 of each sector to the radially outermost tube member 115 so that each group makes a generally fan-shaped core A. The tube members 115 of adjacent pairs of the cores A are arranged in such a manner that the circumferential ends of the tube members 115 of one core A are located radially between the circumferential ends of the tube members 115 of the other core A.

The tube members 115 also can be arranged in such a manner that the circumferential ends of the tube members 115 of one core A face the circumferential ends of the tube members of an adjacent core A.

Figure 4:
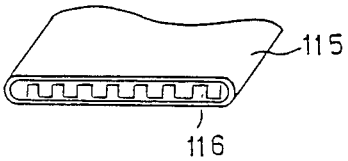
FIG. 4 is a perspective view showing a part of tube.

As shown in FIG. 4, an inner fin 116 which disturbs the flow of the engine oil passing through a tube member 115 is provided within each tube member 115. A number of inwardly protruding portions (not shown) are formed at the inner side of each tube member 115.

The operation of the heat exchanger of the present embodiment is explained hereinafter. High temperature engine oil from the automotive engine is introduced into the oil filter 160, which is mounted on an upper side of the oil cooler 100, from the oil inlet port 141 formed in the engine block 119 and the passing pipe 129. After the engine oil is filtered while passing through the oil filter 160, the engine oil flows into the fluid path 137 formed in the central connecting bolt 133.

The engine oil introduced into the fluid path 137 is then introduced into the first containing space 111 through the connecting hole 139 and the notches 135*a* formed in the spacer 135. The engine oil in the space 111 flows through the tube members 115 downwardly toward the second containing space 113. Since the outer side of the tube members 115, namely the inside of the housing, is filled by low temperature engine coolant which is introduced through the inlet pipe 125, and exits through the outlet pipe 127 the tube member 115 are cooled by the engine coolant. Therefore, the heat of the engine oil within of the tube members 115 is transferred to the engine coolant through the walls of the tube members 115 so that the oil is cooled. After the temperature of the oil is decreased, the engine oil flows into the second containing space 113. The engine oil in the second containing space 113 flows to the fluid path 137 in the central connection bolt 133 through the notches 131*a* in the central pipe 131 and the second bypass ports 147 of the central connecting bolt 133. The engine oil then returns to the engine through the fluid path 137 and the oil outlet path 143 formed in the engine block 119.

If the tube members 115 are plugged by any foreign objects, the oil pressure within the first containing space 111 increases. The increased oil pressure in the first containing space 111 moves the valve body 151 downwardly when the pressure increases higher than the setting force of the spring 155. Then the oil remaining in the first containing space 111 can flow toward the oil outlet port 143 through the gap between the flange 134 and the valve body 151, the first bypass port 145, the bypass path 149 and the second bypass port 147.

The engine coolant within the housing 101 flows toward the engine through the coolant outlet pipe 127. A radial partition 104 connects the housing 101 and the tube members 115 in the core A located between the coolant inlet and output pipes 125 and 127 so that the coolant flows in a circular path in the housing between the tube members 115 as shown in FIG. 3. Therefore, the coolant within the housing 101 is always replaced by fresh coolant in order to keep the temperature in the housing low.

Since each group of tube members 115 makes a fan shaped core A, as shown in FIG. 3, the effective heat transfer area, through which the heat of the oil passing through the tube members 115 is transferred to the engine coolant, can be maximized so that the heat exchanger of the present embodiment can work effectively.

Figure 10:
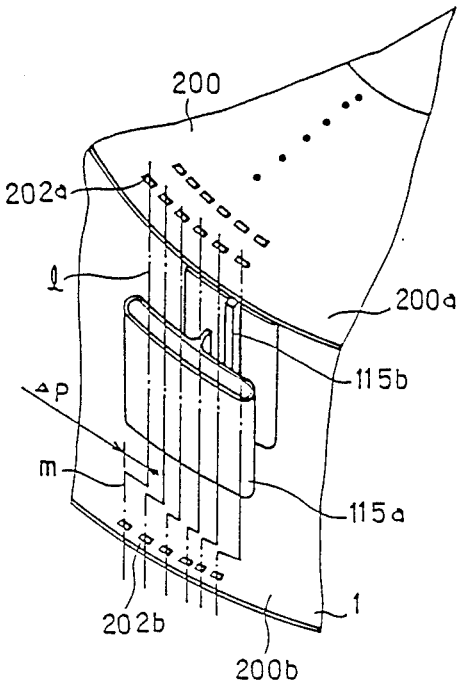
FIG. 10 is an exploded perspective view showing a part of an oil cooler core shown in FIG. 7.
Figure 11:
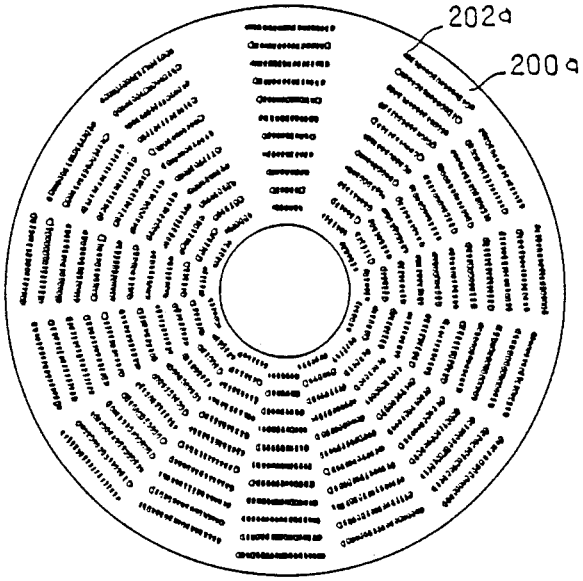
FIGS. 11 and 12 are top views of a plate fin used for the oil cooler shown in FIG. 7.
Figure 12:
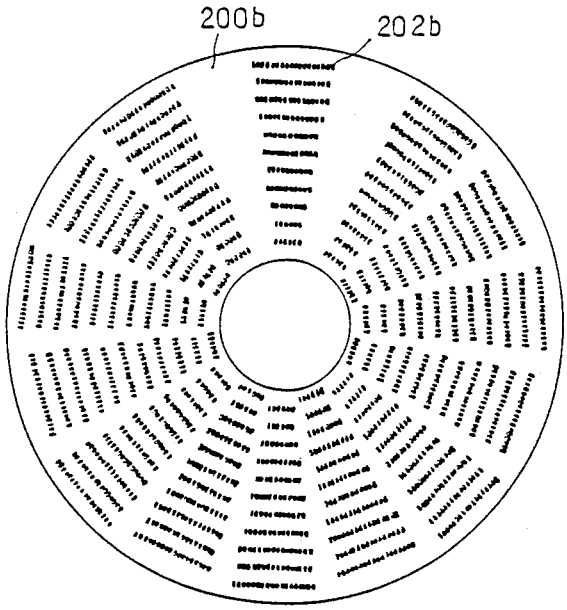
Figure 13:
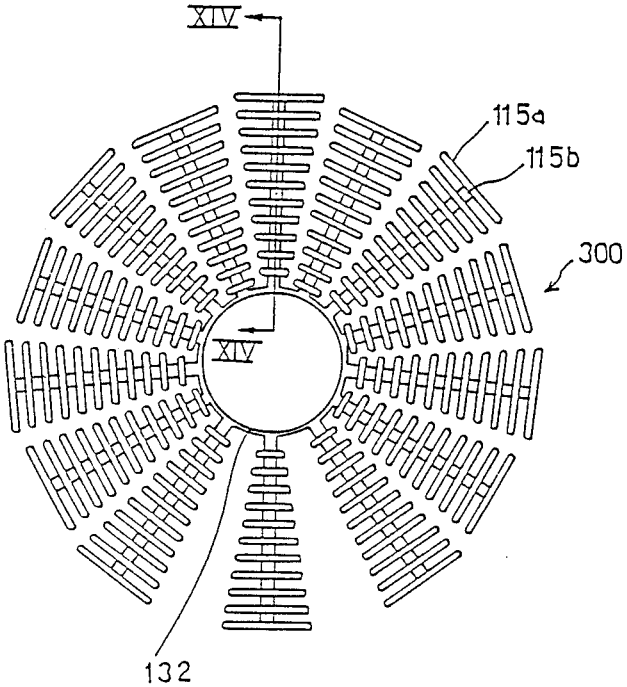
FIG. 13 is a top view of a tube unit used for the oil cooler shown in FIG. 7.
Figure 14:
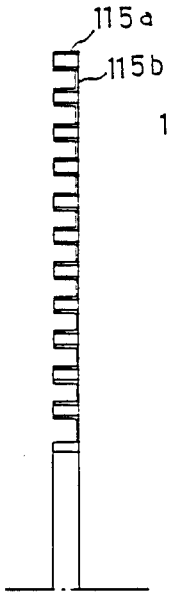
FIGS. 14A and 14B are sectional views taken along line XIV—XIV line of FIG. 13.
Figure 14:
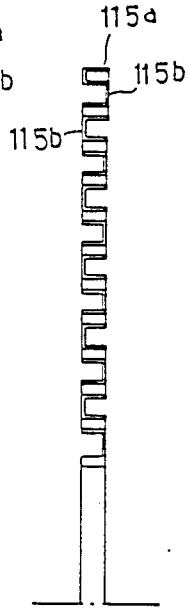

The second embodiment of the present invention is explained hereinafter. The tube members 115 of the present invention are each divided transversely or horizontally into a number of small pieces 115*a* as shown in FIG. 10. The tube member pieces 115*a* in each core A are connected to each other radially by connecting portions 115*b*. The radially inner-most tube member piece 115*a* is connected to a central ring member 132 as shown in FIG. 13. Since a plurality of tube member pieces 115*a* are stacked vertically, they make a tube member 115 and the central ring members 132 make a central pipe 131. As shown in FIG. 14*a* which is a sectional view taken along line XIV—XIV of FIG. 13, a plurality of tube member pieces 115*a* are connected radially to each other by the connecting portions 115*b*, and each connecting portion 115*b* is connected to the tube member pieces 115*a* at one side as shown in FIG. 14(*a*). The connecting portion 115*b* can be connected to alternate sides of the tube member piece 115 as shown in FIG. 14(*b*). A plurality of tube member units 300, made of radially connected pieces 115*a*, shown in FIG. 13, are stacked in such a manner that a plate fin 200 shown in FIGS. 11 or 12 is sandwitched between adjacent units 300. A first type of the plate fin 200*a* and a second type of the plate fin 200*b* have a number of small holes 202*a* and 202*b* at a position that the small holes 202*a* and 202*b* face to the tube member pieces 115A. Both small holes 202*a* and 202*b* are formed by stamping, and the location of the small holes 202*a* is different circularly from that of the small holes 202*b* by one pitch. The first type of the plate fin 200*a* and the second type of the plate fin 200*b* are provided alternately so that the central axis l of the small holes 202*a* is apart from the central axis m of the small holes 202*b* by one pitch as shown in FIG. 10.

Figure 26:
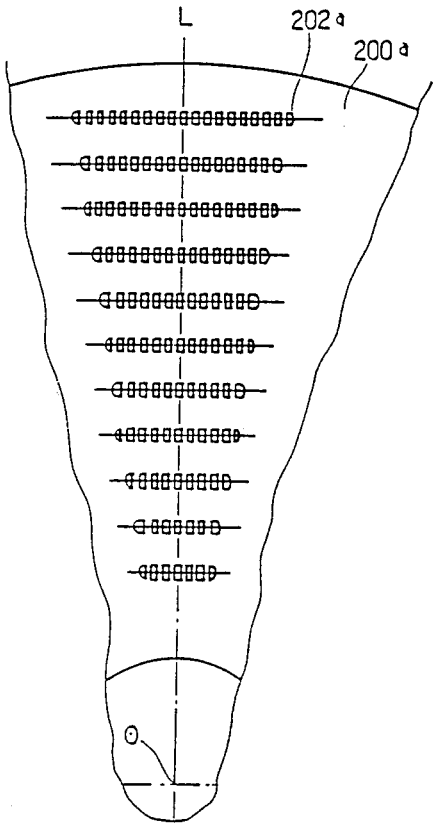
FIG. 26 is a top view of the plate fin shown in FIG. 11.
Figure 27:
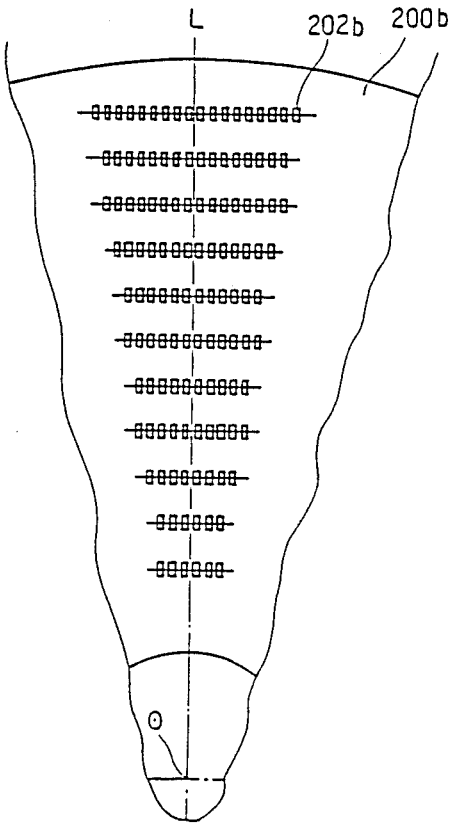
FIG. 27 is a top view showing a part of plate fin shown in FIG. 12.

As shown in FIG. 26 which is an enlarged drawing of FIG. 11, the center small hole 202*a* of the first type plate fin 200*a* locates on the radial axis L. As shown in FIG. 27 which is an enlarged drawing of FIG. 12, the two center small holes 202*b* of the second type of plate fin 200*b* are located on opposite sides of the radial axis L.

Figure 15:
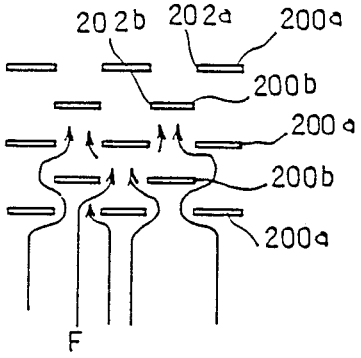
FIG. 15 is a diagram illustrating the flow of the oil in the oil cooler shown in FIG. 7.

Accordingly, the flow of the engine oil in the tube member 115 is well disturbed by the first and second types of the plate fin 202 as shown in FIG. 15. Since the small hole 202*b* of the second type of the plate fin 200*b* disturbs the flow F passing through the small hole 200*a* of the first type of plate fin 200*a*, the flow F becomes serpentine for improving the heat exchange effectively.

Figure 7:
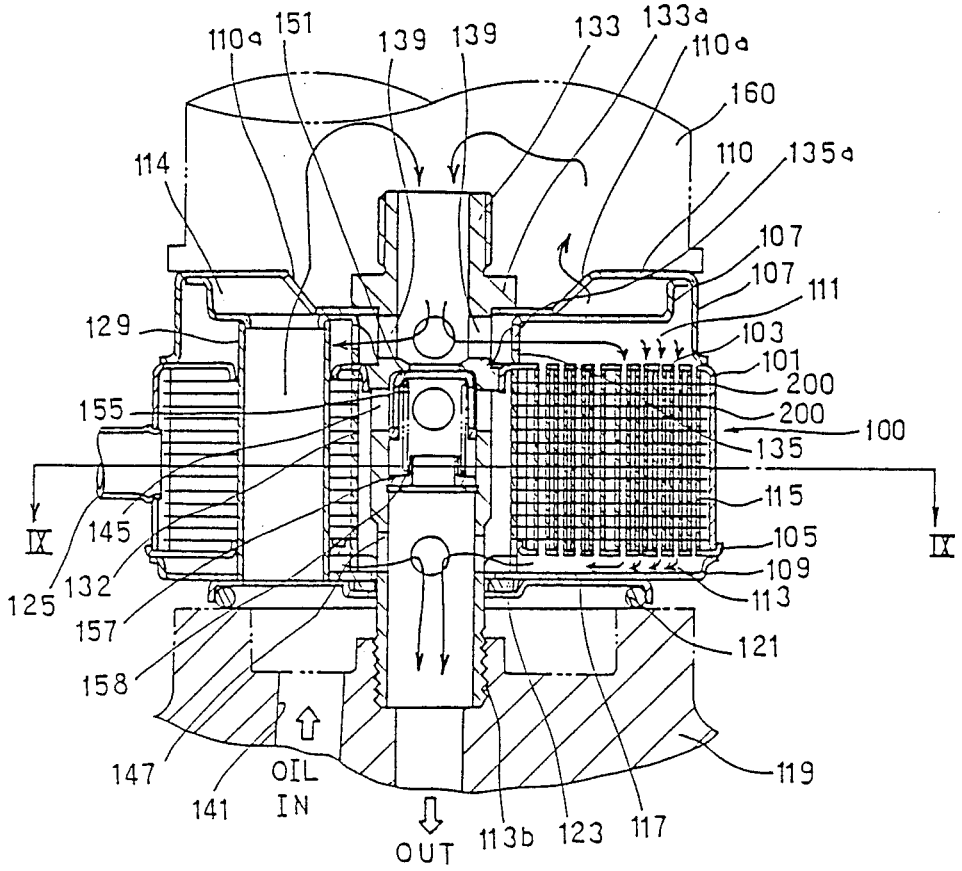
FIG. 7 is a sectional view of an oil cooler of a second embodiment.
Figure 8:
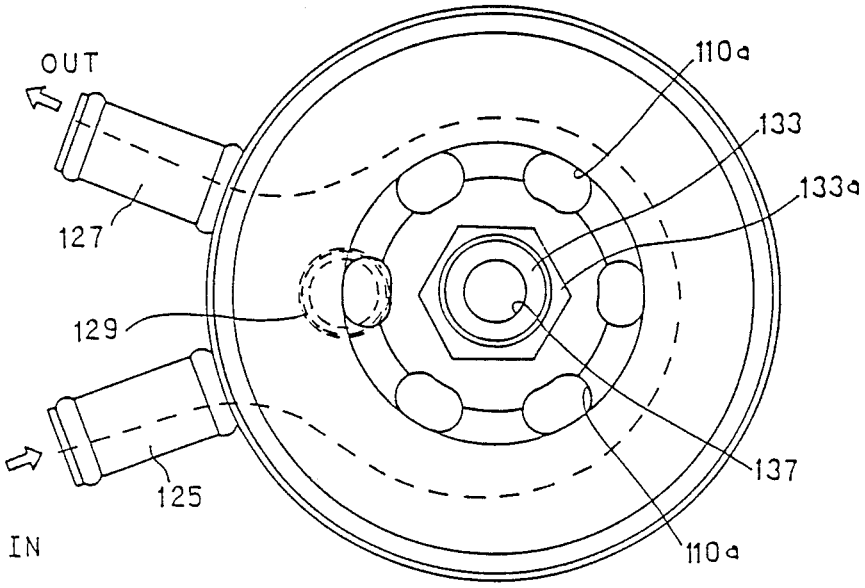
FIG. 8 is a top view of the oil cooler shown in FIG. 7.
Figure 9:
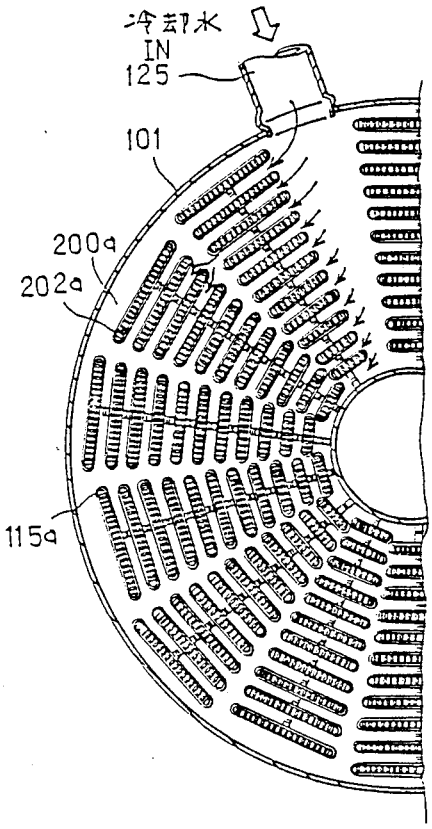
FIG. 9 is a sectional view taken along line IX—IX line of FIG. 7.

As shown in FIG. 7, a third plate 110 on which the oil filter 160 is mounted is provided at the outer side of the first plate 107. The third plate 110 has six through holes 110*a* at a center portion thereof so that the engine oil within a third containing space 114 formed between the third plate 110 and the first plate 107 is introduced into the oil filter 160 through the through holes 110*a*.

Every element numbered the same reference numeral works identically as those of the oil cooler of the first embodiment.

Figure 17:
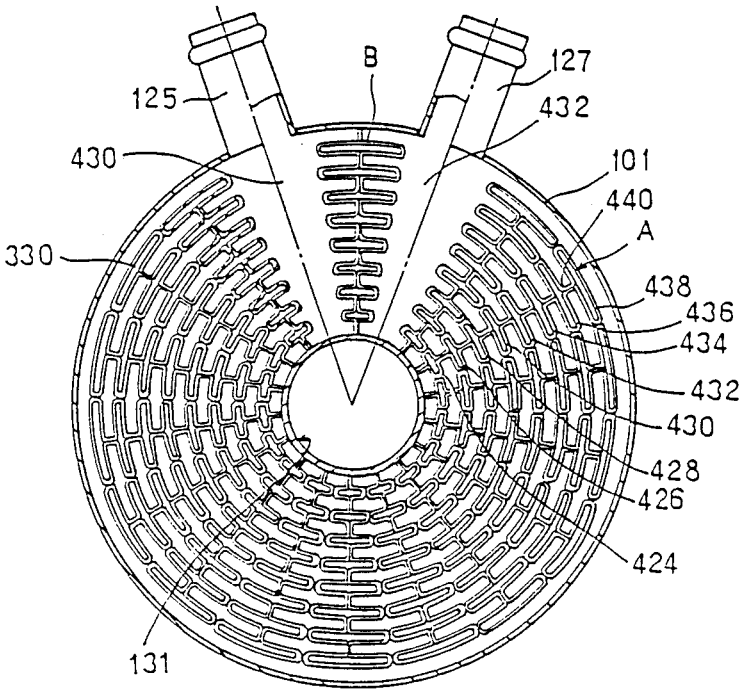
FIG. 17 is a sectional view taken along line XVII—XVII line of FIG. 16.

The engine oil cooler of the third embodiment of the present invention is explained hereinafter. The housing 101 of the present embodiment is made of Fe, Al, or stainless steel, and the coolant inlet pipe 125 and the coolant outlet pipe 127 are connected to the side wall of the housing 101 as shown in FIG. 17. The low temperature engine coolant is introduced into the housing 101 through the inlet pipe 125 from the radiator (not shown) and flows toward the automotive engine (not shown) through the outlet pipe 127.

Figure 18:
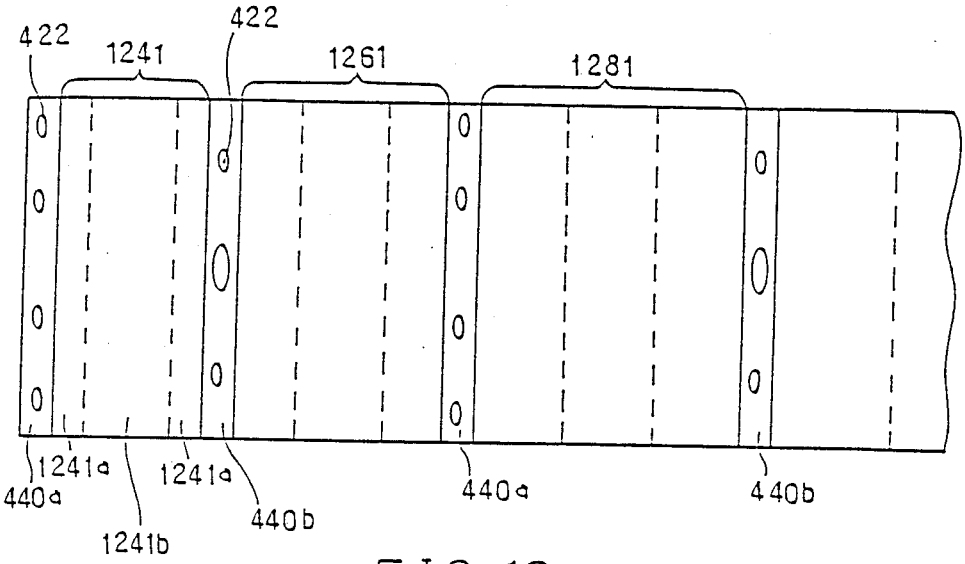
FIG. 18 is a front view showing a part of tube material.

Each core A of the third embodiment is comprised of eight (8) tube member elements 424–438 and a plurality of connecting members 440 which radially connect adjacent pairs of the tube member elements. Each connecting member 440 has a plurality of through holes 422 through which the engine coolant within the housing 101 flows so that the through holes 422 disturb the flow of the engine coolant within the housing 101. The tube members 115 of the third embodiment are formed from a stainless steel strip. A plurality of through holes 422 are formed at predetermined portions of the strip, such portion become the connecting members 440 after the strip is bent as shown in FIG. 18. Namely, four through holes 422 are formed in first connecting members 440*a* and three holes 422 are formed in second connecting members 440*b*. The first connecting members 440*a* and the second connecting members 440*b* are formed alternately. The distance between the first connecting member 440*a* and the second connecting member 440*b* is gradually varied so that the distances are increased from a predetermined small distance to the longest distance and decreased from the longest distance to a predetermined small distance as shown in FIG. 18.

Figure 19:
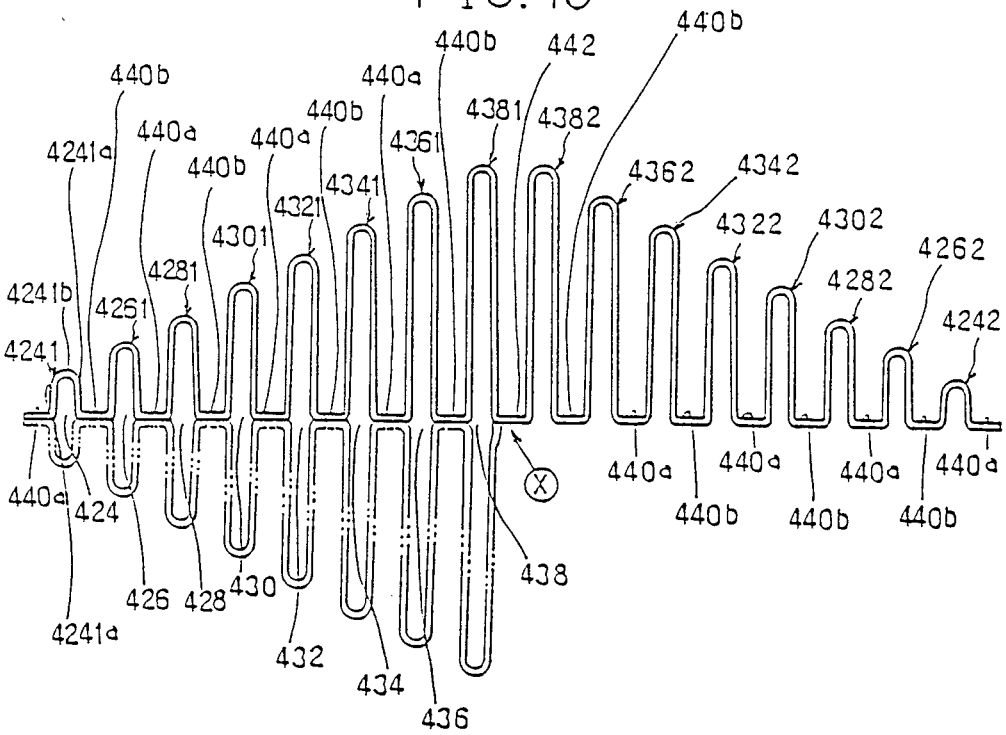
FIG. 19 illustrates a forming step for a tube unit shown in FIG. 17.

The strip shown in FIG. 18 is then bent to form a plurality of tube member elements as shown in FIG. 19. The left most part of the strip in FIG. 19 is the first connecting portion 440*a* and the second left most portion of the strip is a half portion 4241 of the tube member 424. The half portion 4241 is formed by two side wall portions 4241*a* and a semi-circular wall portion 4241*b* connecting the side wall portions 4241*a*. The side wall portions 4241*a* are formed from the portions 1241*a* of the strip, and the semi-circular portion 4241*b* is formed from the portion 1241*b* of the strip shown in FIG. 18.

The left most half portion 4241 of the tube member 424 is connected the second left most hafl portion 4261 of tube member 426 via the second connecting portion 440*b*, and each two adjacent half portions 4261–4381 of tube member elements 424–438 are connected to each other via the first connecting portions 440*a* or the second connecting portions 440*b*. Each half portion 4241–4381 of the tube member elements 424–438 is formed of two side wall portions and a semi-circular portions. The width of the side portion of each half portion of tube member elements gradually increase from the first half portion 4241 of tube member element 424 to the eighth half porton 4381 of tube member element 438.

The half portions of the tube member elements are formed symmetrically as shown in FIG. 19, and the central connecting portion 442 connecting the eighth half portion 4381 with the ninth half portion 4382 tube member elements has no through holes.

After the strip is formed to the symmetrical shape shown by solid lines in FIG. 19, the strip is then bent around the central connecting portion X so that each of the right side half portions 4382–4242 of tube member elements abuts the corresponding left side half portions 4381–4241 of tube member elements 438–424 as shown by dotted lines in FIG. 19. It should be noted that the through holes of each of the first and the second connecting portions 440*a* and 440*b* of the left side portions are exactly fitted to the through holes formed in the first and second connecting portions 440*a* and 440*b* of the right side portions.

After the cores A are formed by the above described steps, they are is arranged in the housing in such a manner that the inner side of each core A is connected to the central pipe 131 and the outer side of the core A is connected to the inner side of the housing wall 101. No core A is provided in that portion in the housing 101 between the inlet pipe 125 and the outlet pipe 127. Instead a core B is located between the portions 430 and 432 which the inlet pipe 125 and the outlet pipe 127 face respectively. The core B is exactly the same shape as that of the core A but has no through holes in the first and second connecting portions 440*a* and 440*b*. The core B divides the inner space of the housing 101 to make the flow of the coolant introduced through the inlet pipe 125 circular and counter-clockwise with respect to the showing of FIG. 17.

Figure 16:
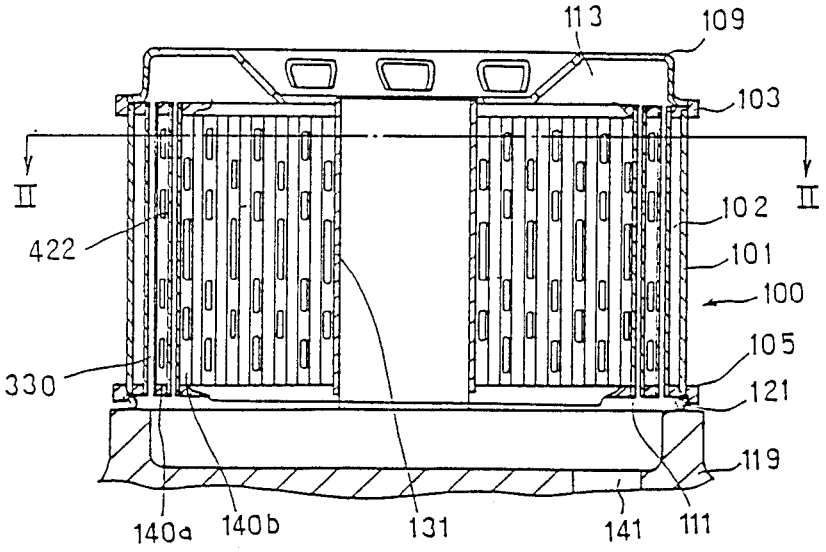
FIG. 16 is a sectional view of an oil cooler of a third embodiment.

The housing containing the core A and the core B is closed its top by the upper end plate 103 and is closed its bottom by the lower end plate 105, as shown in FIG. 16. The upper plate 103 and the lower plate 105 are fixed to the circular wall 101 by welding. Welding material is cladded on the outer surface of the cores A and adjacent pairs of the cores A are fixed each other by welding. The second plate 109 is fixed to the upper side of the upper end plate 103 to form the second containing space 113. The oil cooler of the present embodiment is mounted on the engine block 110 via an O-ring 121 so that the first containing space 111 is formed between the lower end plate 105 and the engine block 119. The lower end plate 105 of the third embodiment works identically as the first plate 107 of the first embodiment.

The operation to the cooler shown in FIGS. 16 and 17 is explained hereinafter. The engine coolant is introduced into the housing 101 through the inlet pipe 125 and flows within the housing 101 counter-clockwise with respect to showing of FIG. 17 so that the engine coolant passes through holes 422. Since the through holes 422 formed in the first connecting member 440*a* do not face the through holes 422 formed in the second connecting member 440*b*, the flow passing through the through holes 422 is disturbed so that heat can transfer effectively.

The engine oil introduced into the first containing space 111 from the oil inlet path 141 flows upwardly through the tube members 424–438 within the housing so that the engine oil is cooled by the engine coolant within the housing. After being cooled, the engine oil flows into the second containing space 113 and then flows toward the oil filter (not shown). The engine oil passed through the oil filter is introduced into the central pipe 131 and flows toward the engine.

Figure 20:
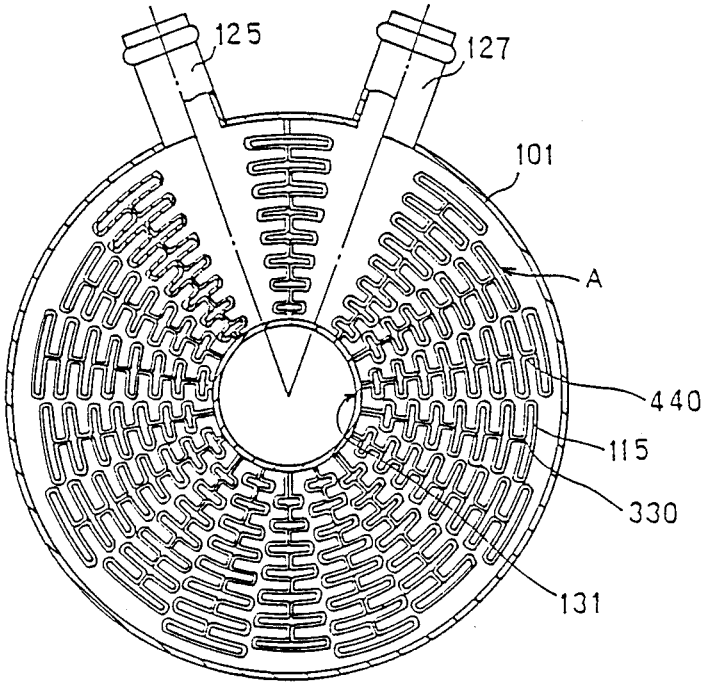
FIG. 20 is a sectional view of a oil cooler of another embodiment.

The core A of the third embodiment can be modified as shown in FIG. 20. The side ends of the tube member elements 115 of one core A are located between the side ends of the tube member elements 115 of an adjacent core A, so that the flow passing through through holes 422 formed in the connecting members 440 is disturbed.

Figure 21:
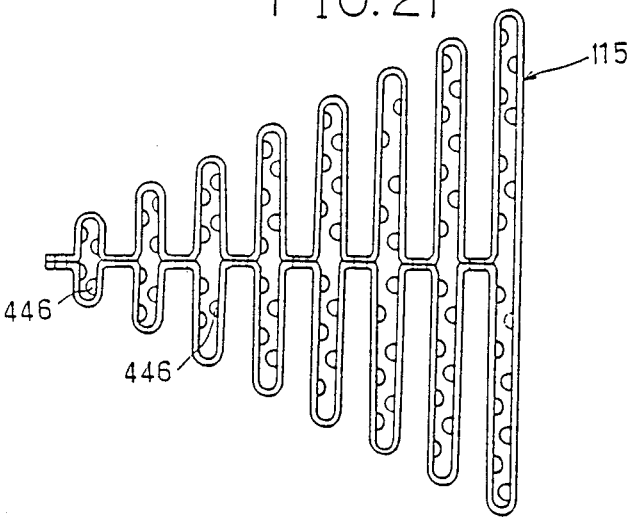
FIG. 21 is a sectional view showing a tube unit for another embodiment.

A number of dimple portions 446 can be formed at the inner surface of the tube member elements 115 as shown in FIG. 21 in order to disturb the flow of the engine oil within the tube member.

Figure 22:
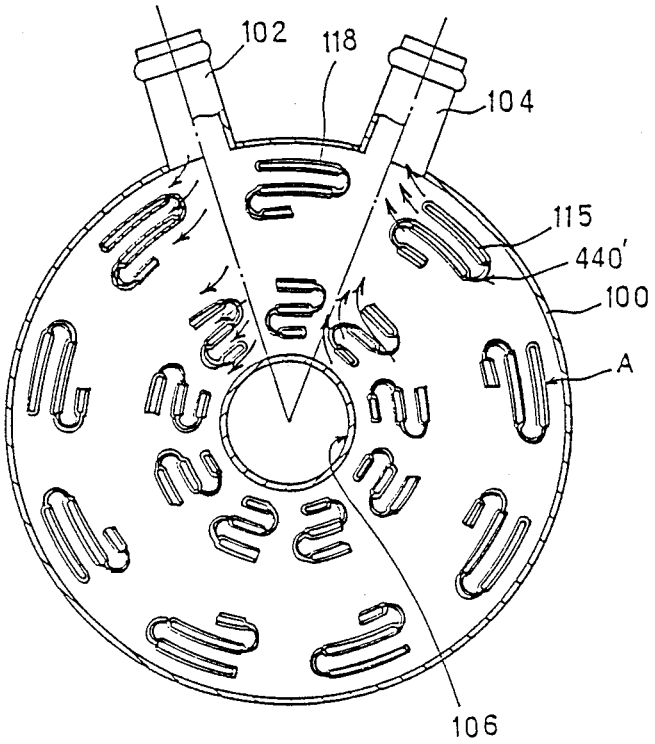
FIG. 22 is a sectional view showing a part of a heat exchanger of a fourth embodiment.
Figure 23:
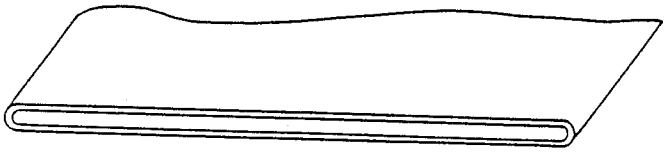
FIG. 23 is a perspective view of the tube used for the oil cooler shown in FIG. 22.
Figure 24:
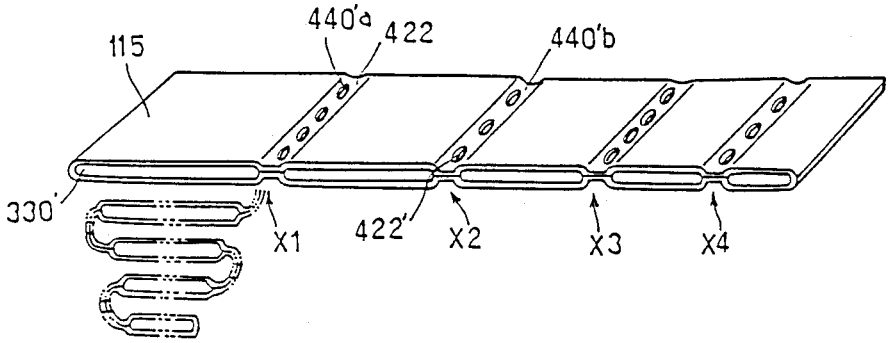
FIG. 24 is a perspective view showing a tube unit used for the oil cooler shown in FIG. 22.
Figure 25:
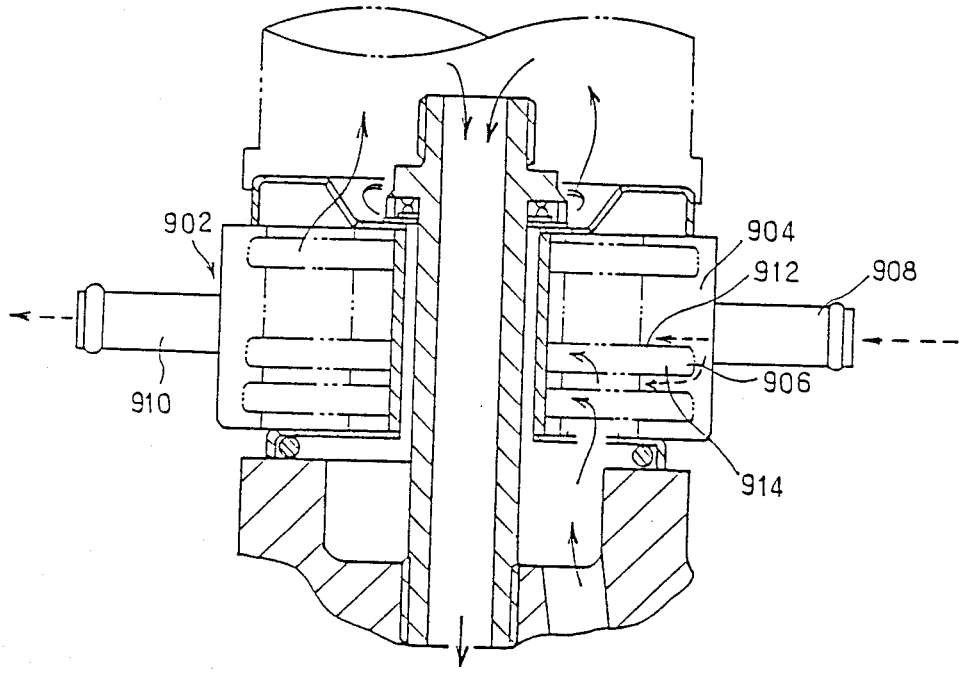
FIG. 25 (PRIOR ART)
FIG. 25 is a sectional view showing a conventional type of an oil cooler.

The fourth embodiment of the present invention is explained hereinafter. As shown in FIG. 22, the core A of the fourth embodiment has a plurality of tube member elements 115 connected to each other by connecting members 440' having through holes 422' therein. The core A of the fourth embodiment is made from a stainless steel seamless pipe. The seamless pipe is machined to be a flat tube as shown in FIG. 23, and further machined to have a plurality of connecting members 440' having through holes 422' therein and a plurality of tube member elements 115 as shown in FIG. 24. The first connecting member 440'*a* has four through holes 422' and the second connecting member 440'*b* has three through holes. The first connecting member 440'*a* and the second connecting member 440'*b* are formed alternately. The machined stainless seamless pipe is then bent to be serpentine as shown by dotted line in FIG. 24. The numerals $X_1$–$X_4$ show the central axes around which the tube member elements are bent.

As described above, the oil cooler of the present invention can cool the engine oil passing through the tube members very effectively. Since a plurality of tube members are arranged in the housing in such a manner that a group of tube member elements make a sector or fan-shaped core and that a group of cores are arranged circularly, the effective surface of the tube member elements through which the heat of the oil within the tube member elements transfer to the outside of tube member elements can be maximized.

What is claimed is:

1. An oil cooler comprising:

a cylindrical wall having end plates to define a housing having an inner space therein;

an engine coolant inlet pipe connected to said wall to introduce engine coolant into said housing;

an engine coolant outlet pipe connected to said wall near said inlet pipe to remove engine coolant from within said housing;

radial partition means within said housing between said inlet and outlet pipes so that engine coolant will flow circularly within said housing from said inlet pipe to said outlet pipe;

first means including one of said end plates defining a first oil-containing space at one end of said housing;

second means including the other of said end plates defining a second oil-containing space at the other end of said housing; and a plurality of tube members within said housing extending between and opening through said end plates to communicate said oil-containing spaces with each other through said tube members, the cross sectional shape of each of said tube members being generally elliptical with the short axis thereof being arranged generally radially of said circular wall, said tube members being arranged in groups with the members in each group being aligned generally radially and with the long axes of the group members gradually decreasing from the radially outermost member so that each group defines a sectorial or fan-shaped core, said cores being arranged circularly within said housing.

2. An oil cooler as claimed in claim 1 including:

an oil-passing pipe extending through the end plates and the first and second spaces, the end of said passing pipe at the one end of said housing being adapted to be connected to an engine oil inlet port from which hot engine oil is introduced, the other end of said passing pipe being adapted to be connected to the second oil-containing space and the first oil-containing space being adapted to be connected to an engine oil outlet port into which cooled oil is introduced.

3. An oil cooler as claimed in claim 1 including means for connecting one of said oil-containing spaces to an engine oil inlet port from which hot oil is introduced and means for connecting the other of said oil-containing spaces to an engine oil outlet port into which cooled oil is introduced.

4. An oil cooler as claimed in claim 3 wherein the housing is adapted to be mounted between an oil filter, into which oil is introduced after passing through said housing from the oil inlet port and returns from the filter into the one oil-containing space, and an engine block containing the oil inlet and outlet ports.

5. An oil cooler claimed in claim 1 wherein;

each tube member has an inner fin for disturbing the flow of the engine oil passing through said tube member.

6. An oil cooler claimed in claim 1, wherein:

the side end portions of the tube members of one of the cores are aligned radially between the side end portions of the tube members of adjacent cores.

7. An oil cooler claimed in claim 1, wherein:

the side end portions of the tube members of one of the cores are aligned radially with the side end portions of the tube members of adjacent cores.

8. An oil cooler claimed in claim 1, wherein:

the tube members are divided transversely into a plurality of tube member elements; and further including:

a plurality of fin plates sandwiched between adjacent ones of said tube member elements, said fin plates having a number of small holes through which engine oil within one of said tube member elements flows toward an adjacent tube member element.

9. An oil cooler claimed in claim 8, wherein;

a pair of adjacent said tube member elements are connected each other by a connecting portion.

10. An oil cooler claimed in claim 1, wherein;

a group of said tube members forming one core are made integrally from one flat strip by bending said flat strip in such a manner that bent portions of said strip are connected to each other by connecting portions.

* * * * *